United States Patent [19]

Matsuoka et al.

[11] Patent Number: 4,522,180

[45] Date of Patent: Jun. 11, 1985

[54] AIR-FUEL RATIO CONTROL APPARATUS

[75] Inventors: Hiroki Matsuoka; Toshimi Murai, both of Susono, Japan

[73] Assignee: Toyota Jidosha Kabushiki Kaisha, Toyota, Japan

[21] Appl. No.: 491,643

[22] Filed: May 4, 1983

[30] Foreign Application Priority Data

Nov. 12, 1982 [JP] Japan ..... 57-197729

[51] Int. Cl.[3] ..... F02D 33/00

[52] U.S. Cl. ..... 123/489; 123/440

[58] Field of Search ..... 123/489, 440, 589; 60/276; 73/23

[56] References Cited

U.S. PATENT DOCUMENTS 4,167,925 9/1979 Hosaka et al. ..... 123/489

4,324,218 4/1982 Hattori et al. ..... 123/489

4,338,900 7/1982 Dilger et al. ..... 123/489

*Primary Examiner*—Andrew M. Dolinar

*Attorney, Agent, or Firm*—Cushman, Darby & Cushman

[57] ABSTRACT

An air-fuel ratio control apparatus in which air-fuel ratio detecting signal represents air-fuel ratio in a combustion chamber and an integrated amount increased or decreased in relation to the air-fuel ratio detecting signal is calculated from the air-fuel ratio detecting signal on the basis of parameters to correct fuel amount supplied to an intake system on the basis of the integrated amount. The frequency of the air-fuel ratio detecting signal when the air-fuel ratio in the combustion chamber reaches a predetermined value is defined as the basic frequency. To compensate for change with the passage of time in the output characteristics of an air-fuel ratio detecting sensor, said parameter value is corrected so that the frequency of the air-fuel ratio detecting signal becomes the basic frequency.

26 Claims, 12 Drawing Figures

AIR-FUEL RATIO CONTROL APPARATUS

BACKGROUND OF THE INVENTION

1. Field of the Invention:

This invention relates to an air-fuel ratio control apparatus in an electronically controlled engine for a vehicle, and more particularly to an air-fuel ratio control apparatus capable of maintaining accuracy in air-fuel ratio control satisfactorily despite changes over time in the output characteristics of an air-fuel ratio sensor.

2. Description of the Prior Art:

In an air-fuel ratio control apparatus for an electronically controlled engine, the output of an oxygen sensor (hereinafter called "$O_2$ sensor") is used to generate a feedback signal. The $O_2$ sensor is of a type used for detecting the air-fuel ratio of a mixture in a combustion chamber of the engine from the oxygen concentration in an exhaust system. It changes the level of its output voltage as it detects approximately the stoichiometric air-fuel ratio. However the output characteristics are changed with the passage of time due to degradation or the like and thereby a problem is encountered that the air-fuel ratio also deviates from the stoichiometric air-fuel ratio. Thus, in the prior art, the amplitude of the air-fuel ratio detecting signal from the $O_2$ sensor is detected to correct a comparative voltage compared with the air-fuel ratio detecting signal in relation with the amplitude for shaping the air-fuel ratio detecting signal. While this prior art can dispose of the change with the passage of time in air-fuel ratio when the amplitude of the air-fuel ratio detecting signal and rich signal and lean signal of the air-fuel ratio detecting signal are changed over (this changed-over air-fuel ratio is approximately the stoichiometric, air-fuel ratio in the normal air-fuel ratio detecting signal), response time in which the air-fuel ratio detecting signal is changed from the rich signal to the lean signal as the air-fuel ratio changes differs from one in which same is changed reversely. In the prior art, it was difficult to hold the air-fuel ratio at a target value by disposing of the change with the passage of time in the difference between these response times.

SUMMARY OF THE INVENTION

An object of the present invention is to provide an air-fuel ratio control apparatus which can maintain air-fuel ratio at a target value by disposing of not only the amplitude of air-fuel ratio detecting signal and the air-fuel ratio at change-over point, but also change with the passage of time in the difference between response times.

A air-fuel ratio sensor showing that the air-fuel ratio is larger than the stoichiometric air-fuel ratio as the target value, i.e. mixture is deviated to be lean is called a lean sensor. On the other hand, the air-fuel sensor showing that the air-fuel sensor is smaller than the stoichiometrical air-fuel ratio, i.e. the mixture is deviated to be rich is called a rich sensor. Considering the relationship between frequency of the air-fuel ratio detecting signal and the rich sensor or lean sensor, this invention corrects the values of parameters used in computating integrated amount, on which the calculation of fuel injection amount is based, in relation to the frequency of air-fuel ratio detecting signal.

Namely, according to the present invention, in an air-fuel ratio control apparatus wherein the air-fuel ratio detecting signal represents air-fuel ratio in the combustion chamber and integrated amount increased or decreased in relation with this air-fuel ratio detecting signal is calculated on the basis of the parameters from the air-fuel ratio detecting signal to correct fuel amount supplied to an intake system on the basis of the integrated amount, the frequency of the air-fuel ratio detecting signal is defined as the basic frequency when the air-fuel ratio in the combustion chamber reaches a predetermined value and the frequency of the air-fuel ratio detecting signal is detected to correct said parameter values on the basis of the frequency of the air-fuel ratio detecting signal so that the frequency of the air-fuel ratio detecting signal provides the basic frequency.

On cycle of the air-fuel ratio detecting signal includes simultaneously the response time in which mixture is changed from lean to rich one and that in which the mixture is changed reversely, so that the frequency of the air-fuel ratio detecting signal is neither affected by the amplitude of the air-fuel ratio detecting signal and the air-fuel ratio in the change-over point, nor by the difference between the response times. Thus, how the output characteristics of the air-fuel ratio detecting signal are deviated with the passage of time can be accurately detected from the frequency of the air-fuel ratio detecting signal.

The value of parameter is preferably corrected by feedback control. Namely, the value of parameter is corrected on the basis of the deviation of detected frequency of the air-fuel ratio detecting signal from the basic frequency.

In an electronically controlled engine wherein target air-fuel ratio is set to the stoichiometrical air-fuel ratio, the basic frequency is defined as the frequency of the air-fuel ratio detecting signal when the air-fuel ratio in the combustion chamber becomes approximately the stoichiometric air-fuel ratio.

In the calculation of integrated amount, the air-fuel ratio detecting signal is compared with the comparative value to be converted to a binary variable, and in a predetermined delay time after the value of the binary variable is changed the integrated amount is increased or decreased intermittently by a predetermined skip amount. In a preferred embodiment of the present invention, said parameter is the comparation value, delay time or skip amount.

The frequency of the air-fuel ratio detecting signal varies somewhat with the running region of an engine. Preferably the frequency of the air-fuel ratio detecting signal is detected in the running region of the engine where the change with the passage of time in the characteristics of the air-fuel ratio detecting signal is easy to detect, for example in medium load-steady travelling period. The detecting region can be defined from vehicle speed, speed of revolution of engine, engine load, opening of a throttle valve, shift position (drive range position) of an automatic transmission, etc.

The correction of the value of parameter can apply to the whole running region of engine irrespective of limitation of detecting region.

Preferably the number of times by which the air-fuel ratio detecting signal crosses the comparation value is counted to detect the frequency of the air-fuel ratio detecting signal from the counted value.

Or the number of times by which the air-fuel ratio detecting signal is changed from increase to decrease and/or from decrease to increase may be counted to detect the frequency of the air-fuel ratio detecting signal from the counted value.

To improve reliability of air-fuel ratio control, the value of parameter is preferably corrected on the basis of average value of detected frequency of the air-fuel ratio detecting signal.

The above-mentioned and other objects and features of the invention will become apparent from the following detailed description taken in conjunction with the drawings which indicate an embodiment of the invention.

BRIEF DESCRIPTION OF THE DRAWINGS

FIG. 3 shows change with the passage of time in air-fuel ratio detecting signal or the like;

DETAILED DESCRIPTION OF PREFERRED EMBODIMENT

Figure 1:
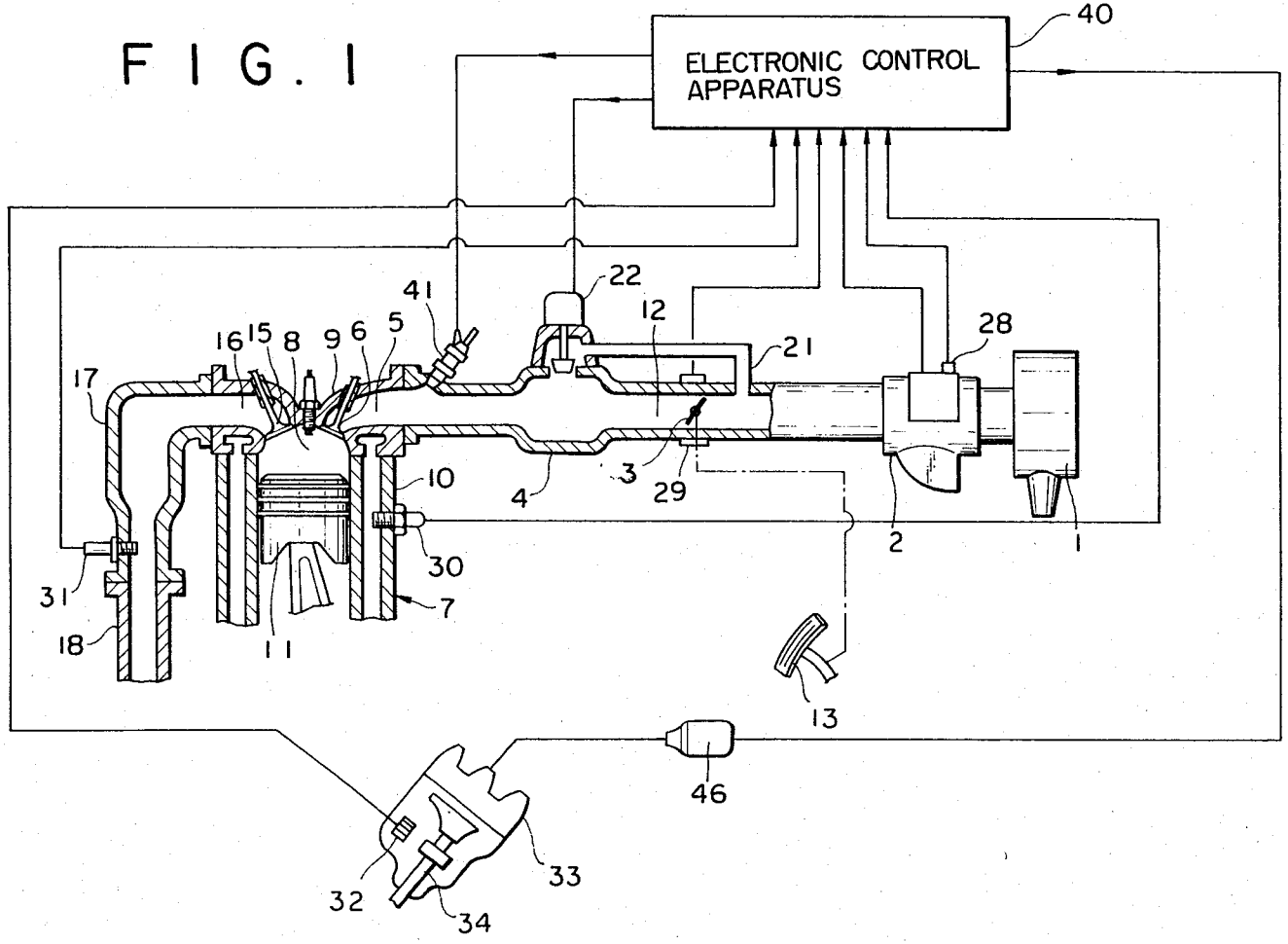
FIG. 1 is a constitutional drawing of the whole electronically controlled engine according to the present invention.

FIG. 1 is a constitutional drawing of a system of an electronically controlled engine according to the present invention. Air sucked from an air cleaner 1 is sent to a combustion chamber 8 of an engine body 7 through an intake path 12 including an air flow meter 2, a throttle valve 3, a surge tank 4, an intake port 5 and an intake valve 6. The throttle valve 3 is interlocked with an accelerator pedal 13 in a cab. The combustion chamber 8 is defined by a cylinder head 9, a cylinder block 10 and a piston 11, and exhaust gas produced by combustion of mixture is purged to the atmosphere through an exhaust valve 15, an exhaust port 16, an exhaust manifold 17 and an exhaust pipe 18. A bypass path 21 connects the upstream side of the throttle valve 3 to the surge tank 4, and ISC valve (idle revolution speed control valve) 22 controls the sectional area of flow in the bypass path 21 to maintain the speed of revolution of the engine in idling constant. An intake air temperature sensor 28 provided in the air flow meter 2 detects intake air temperature, and a throttle position sensor 29 detects the opening of the throttle valve 3. A water temperature sensor 30 mounted on the cylinder block 10 detects cooling water temperature, i.e. engine temperature, and an $O_2$ sensor 31 mounted on an aggregate portion of the exhaust manifold 17 detects oxygen concentration in the aggregate portion. A crank angle sensor 32 detects the crank angle of a crankshaft (not shown) from the revolution of a shaft 34 of a distributor 33 connected to the crankshaft in the engine body 7 to generate pulses every time the crank angle changes by 30°. The outputs of these sensors 2, 28, 29, 30, 31 and 32 are sent to an electronic control apparatus 40. An fuel injector 41 corresponding to each cylinder is provided in the proximity of each intake port 5 to inject fuel toward the intake port 5. The electronic control apparatus 40 calculates fuel injection amount from the input signals of the respective sensors to send electric pulses with pulse length corresponding to the calculated fuel injection amount to the fuel injector 41. The electronic control apparatus 40 also controls the ISC valve 22 and an ignitor 46. The secondary side of an ignition coil in the ignitor 46 is connected to the distributor 33.

Figure 2:
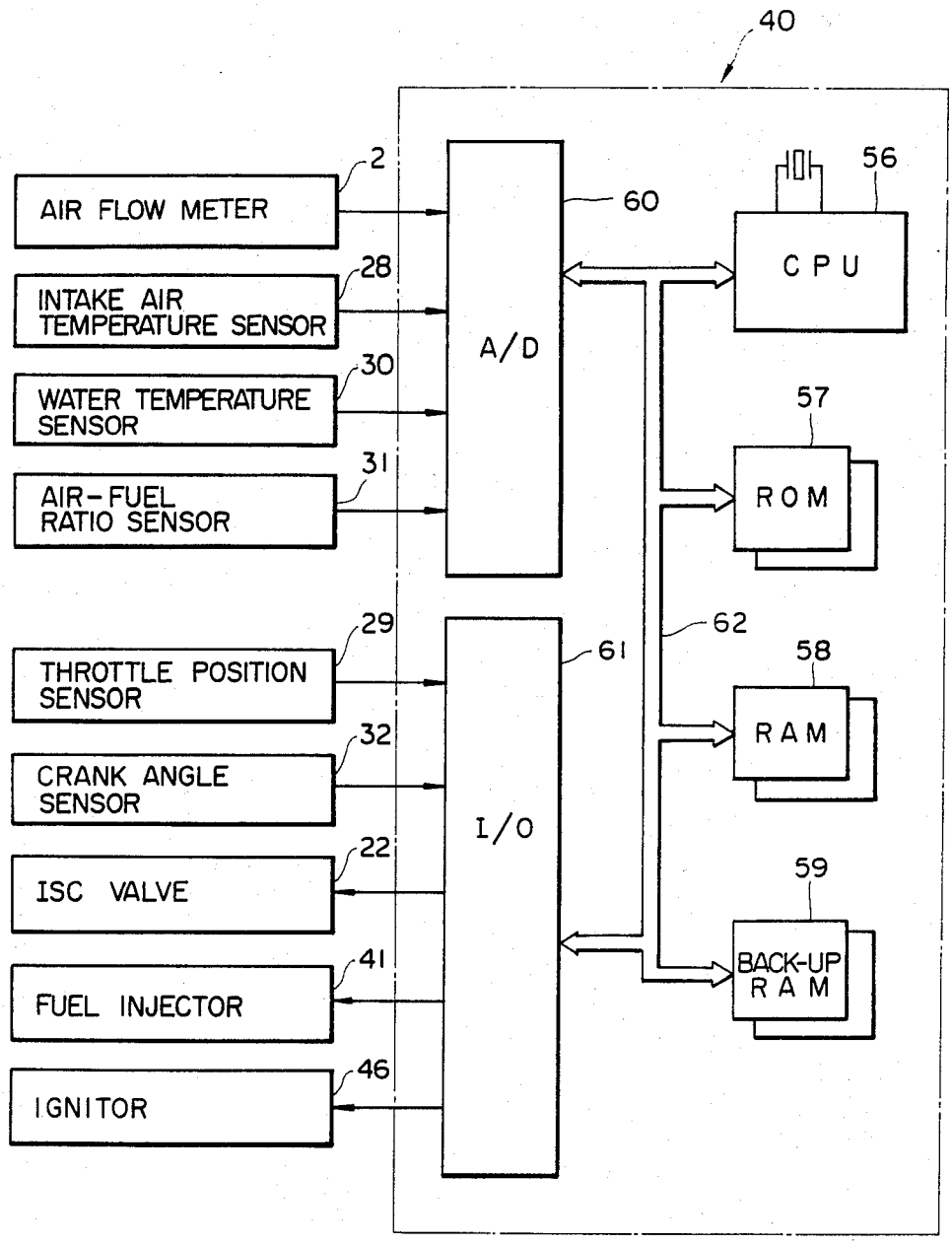
FIG. 2 is a block diagram of the electronic control apparatus shown in FIG. 1.

FIG. 2 is a block diagram of the interior of the electronic control apparatus. CPU 56, ROM 57, RAM 58, back-up RAM 59, A/D (Analog/Digital converter) 60 with a multiplexer and I/O (Input/Output interface) 61 are connected with each other through a bus 62. The back-up RAM 59 is connected with an auxiliary power supply to receive a predetermined power and keep memory even when an ignition switch is opened to stop the engine. Analog signals from the air flow meter 2, intake air temperature sensor 28, water temperature sensor 30 and $O_2$ sensor 31 are sent to the A/D 60. The outputs of the throttle position sensor 29 and crank angle sensor 32 are sent to the I/O 61, and the ISC valve 22, fuel injector 41 and ignitor 46 receive the input signal from the I/O 61.

Figure 3:
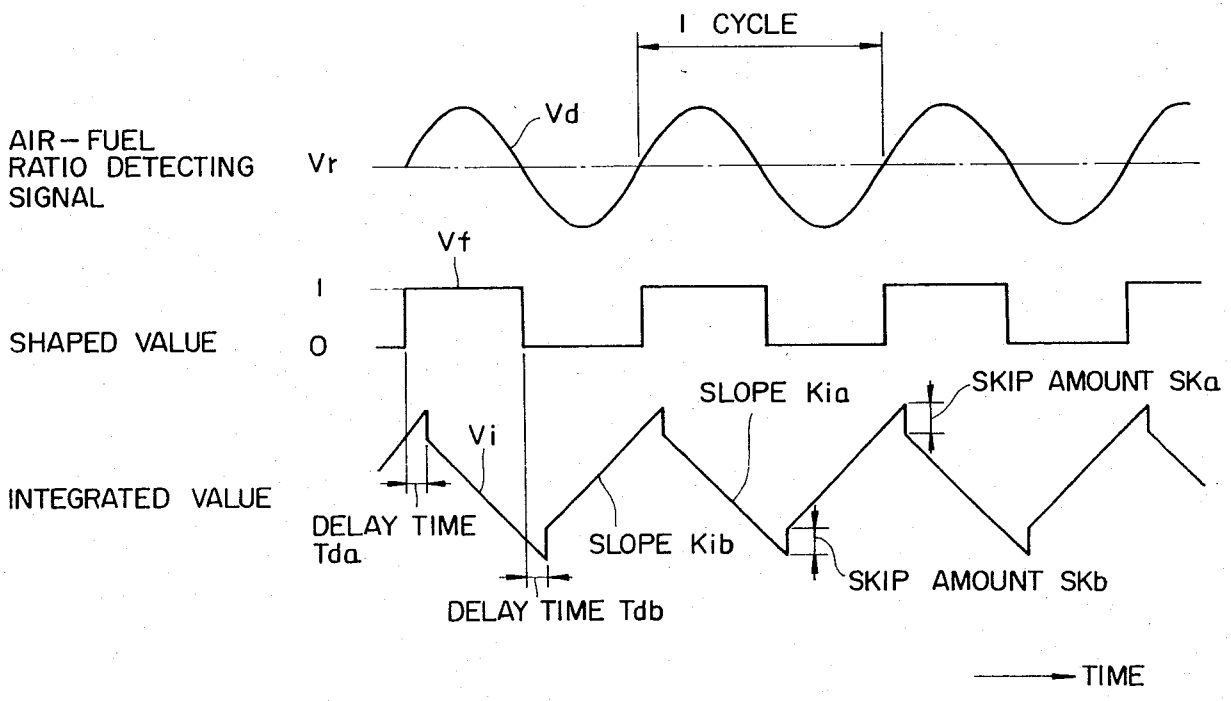

FIG. 3 shows changes with the passage of time in air-fuel ratio detecting signal Vd as the output voltage of the $O_2$ sensor 31, shaped value Vf as binary variable and integrated amount Vi. The air-fuel ratio detecting signal Vd is compared with the comparative voltage Vr to provide $Vf=1$ when $Vd \geqq Vr$ or $Vf=0$ when $Vd < Vr$. In practical calculation processes in the electronic control apparatus 40 is used comparative value instead of the comparative voltage Vr. When a predetermined delay time Tda has elapsed after Vf was changed from 0 to 1, Vi is decreased intermittently by skip amount Ska and thereafter decreased with slope Kia. Also, when a predetermined delay time Tdb has elapsed after Vf was changed from 1 to 0, Vi is increased intermittently by the skip amount Skb and thereafter with slope Kib. Fuel injection amount increases as Vi increases, and the skip and the delay time are provided respectively to improve the responsive property of control and avoid hunting of integrated amount.

Figure 4:
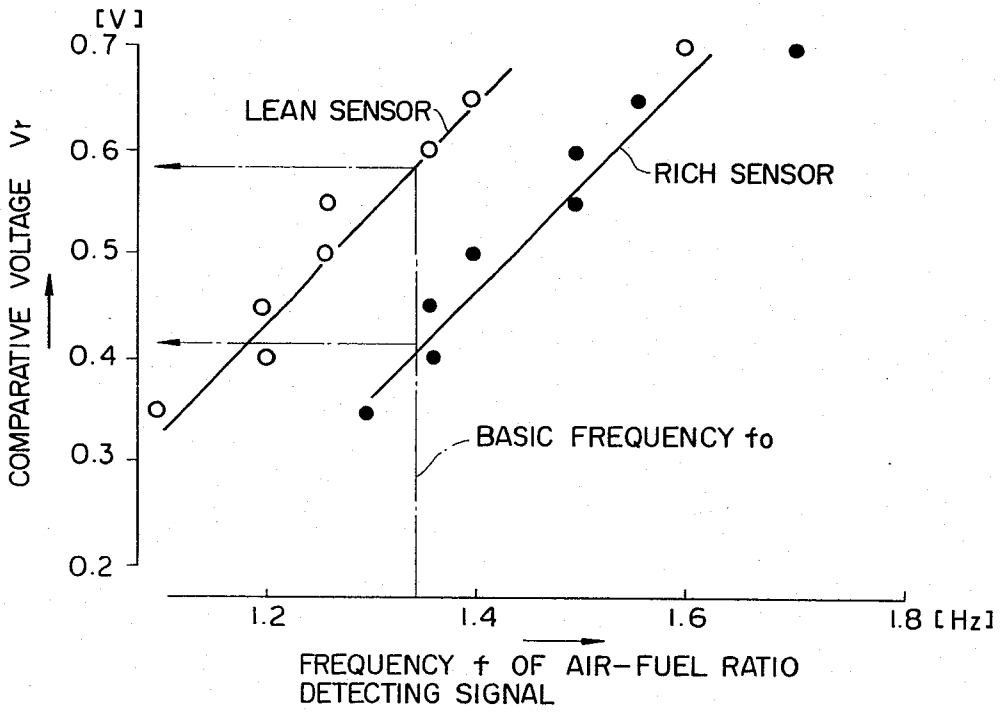
FIG. 4 is a graph showing the relationship between the frequency and comparative voltage of the air-fuel ratio detecting signal.

FIG. 4 is an experimental graph showing the relationship between the frequency f of the air-fuel ratio detecting signal Vd of the lean sensor or rich sensor and the comparative voltage Vr in a period of steady travelling with 40 Km/h of vehicle speed. The $O_2$ sensor showing that the air-fuel ratio is deviated larger than the stoichiometrical air-fuel ratio, i.e. mixture becomes lean is defined as the lean sensor, and the $O_2$ sensor showing that the air-fuel ratio is deviated smaller than the stoichiometrical air-fuel ratio, i.e. the mixture becomes rich is defined as the rich sensor. In FIG. 4, white circles represent the lean sensor and black circles the rich sensor. It will be found from FIG. 4 that while the frequency f of the air-fuel ratio detecting signal of the lean sensor and rich sensor varies with increase or decrease of the comparative voltage Vr, the frequency f of the lean sensor is smaller than that of the rich sensor and change with the passage of time in the output characteristics of the $O_2$ sensor is to be detected from the frequency f.

Figure 5:
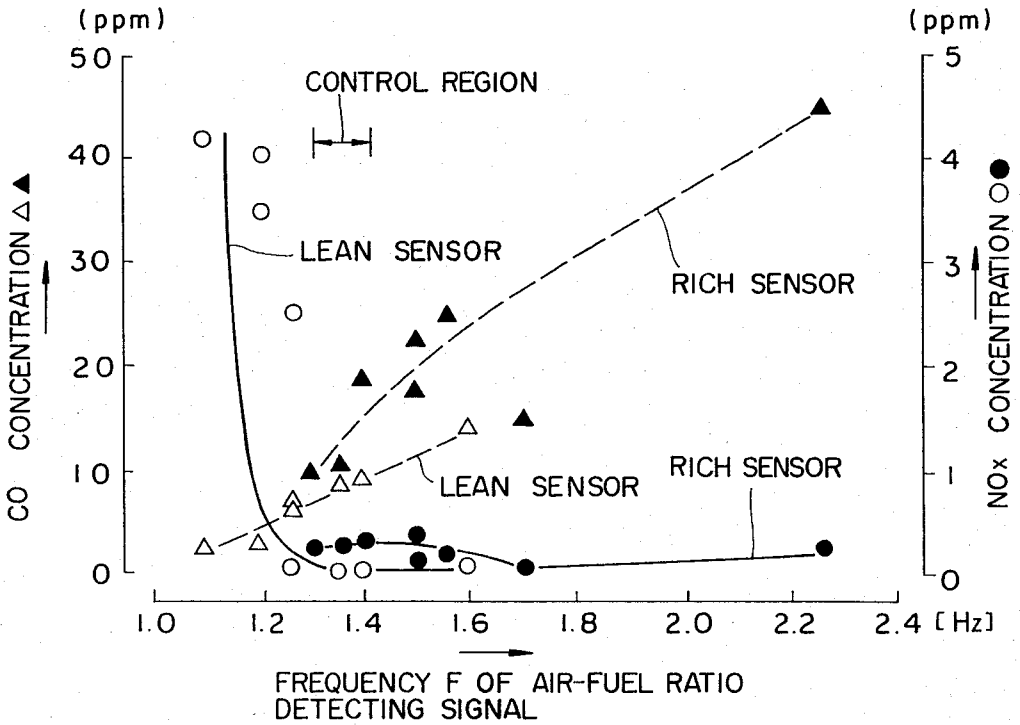
FIG. 5 is a graph showing the relationship between the frequency of air-fuel ratio detecting signal and concentration of carbon monoxide and nitrogen oxide.

FIG. 5 shows the relationship between the frequency f of the air-fuel ratio detecting signal of the lean sensor and rich sensor and concentration of carbon monoxide CO or nitrogen oxide Nox in purged exhaust gas during the period of steady travelling with 40 Km/h of vehicle speed. White circles represent the concentration of Nox in the case of the lean sensor, black circles the concentration of Nox in the case of the rich sensor, white triangles the concentration of CO in the case of the lean sensor and black triangles the concentration of CO in the case of the rich sensor. It will be found from FIG. 5 that when the frequency f in the steady travelling region with 40 Km/h of vehicle speed is within 1.3–1.4 Hz of control range the concentration of CO and the concentration of Nox can be restrained to the minimum both in the cases of the rich and lean sensors. Thus, the basic frequency fo in the period of steady travelling with 40 Km/h of vehicle speed is selected to be about 1.35 Hz (FIG. 4) and the frequency f of the air-fuel ratio detecting signal is controlled to be the basic frequency fo. To control the frequency f of the lean sensor and rich sensor in FIG. 4 such that it becomes the basic frequency fo, the comparative voltage Vr may be set to about 0.4 V and 0.6 V respectively.

Figure 6:
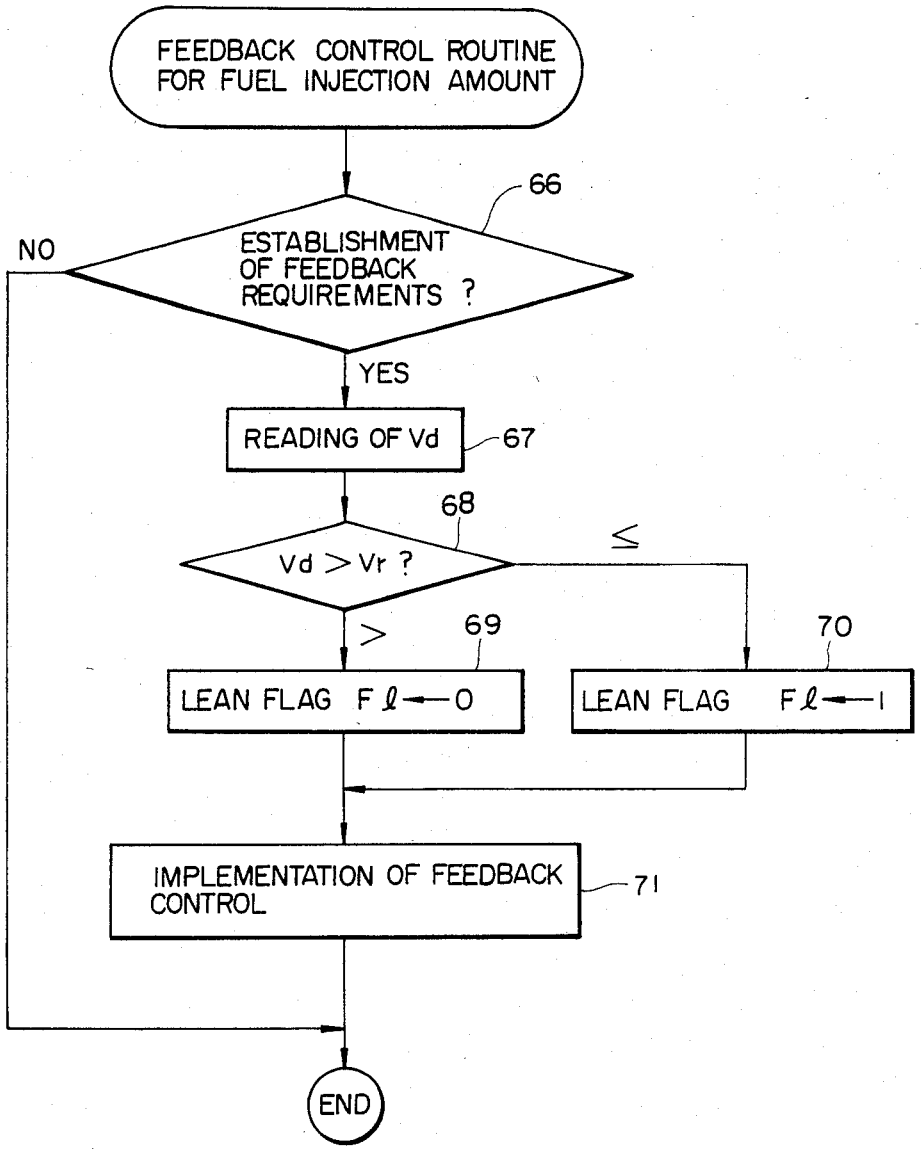
FIG. 6 is a flow chart showing a feedback control routine of fuel injection amount.

FIG. 6 is a flow chart of a feedback control routine of fuel injection amount. In step 66 is judged whether or not feedback control requirements are established and the succeeding steps will be executed only when said requirements are judged to be established. An example of the feedback control requirements is the completion of warming up an engine. In step 67 is read the air-fuel ratio detecting signal Vd of the $O_2$ sensor 31. In step 68 is compared Vd with the comparative voltage Vr, and advance is made to step 69 to reset lean flag Fl if $Vd > Vr$, i.e. mixture is rich and set the lean flag Fl if $Vd \leqq Vr$, i.e. the mixture is lean. In step 71 is carried out the feedback control. Namely the final fuel injection amount is decreased if $Fl = 0$ and increased if $Fl = 1$ with respect to the basic fuel injection amount calculated from engine load Q/N (provided Q is intake air flow and N is the speed of revolution of the engine).

Figure 7:
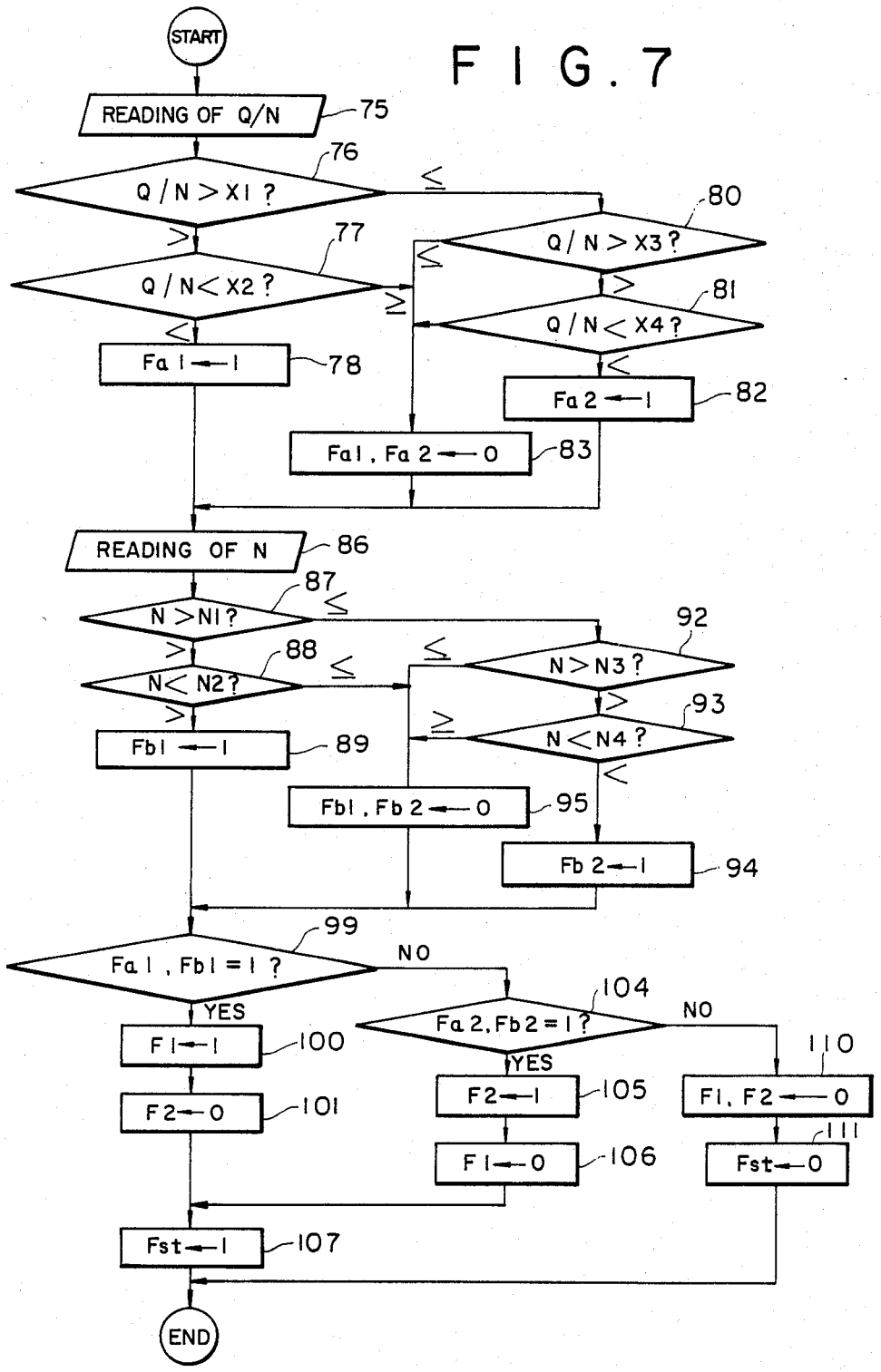
FIG. 7 is a flow chart of a routine for determining whether or not an engine is running in the detecting region of frequency of the air-fuel ratio detecting signal.

FIG. 7 is a flow chart of a routine for judging whether or not the engine is run in a region to detect the frequency f of the air-fuel ratio detecting signal Vd. In the flow chart shown in FIG. 7 this region is detected from the engine load Q/N and the speed N of revolution of the engine. The region to detect the frequency f may be detected from the vehicle speed Vs and speed N of revolution of the engine or from the speed N of revolution of the engine, shift position of an automatic transmission and opening of the throttle valve. Since the frequency f and the basic frequency fo set as the frequency f of the air-fuel ratio detecting signal Vd when air-fuel ratio of mixture in the combustion chamber 8 becomes the stoichiometric air-fuel ratio vary somewhat with the running region of the engine, the region to detect the frequency f is limited to regions where the basic frequency fo in steps 149, 151 in FIG. 8, which will be later described, and table Ta in step 157 are defined.

In steps 75–83, with respect to engine load Q/N, region flag Fa1 is set when $X1 < Q/N < X2$, region flag Fa2 is set when $X3 < Q/N < X4$ and Fa1, Fa2 are reset in the other cases, provide X1–X4 are constants. In step 75 is read Q/N. In step 76 is judged whether or not $Q/N > X1$, and advance is made to step 77 if $Q/N > X1$ and to step 80 if $Q/N \leqq X1$. In step 77 is judged whether or not $Q/N < X2$, and advance is made to step 78 to set region flag Fa1 if $Q/N < X2$ and to step 83 if $Q/N \geqq X2$. In step 80 is judged whether or not $Q/N > X3$ and advance is made to step 81 if $Q/N > X3$ and to step 83 if $Q/N \leqq X3$. In step 81 is judged whether or not $Q/N < X4$ and advance is made to step 82 to set region flag Fa2 if $Q/N < X4$ and to step 83 if $Q/N \geqq X4$. In step 83 are reset both region flags Fa1, Fa2.

In steps 86-94, with respect to the speed N of revolution of engine, region flag Fb1 is set when $N1 < N < N2$, region flag Fb2 is set when $N3 < N < N4$ and Fb1, Fb2 are reset in the other cases, provided N1–N4 are constants. In step 86 is read the speed N of revolution of engine. In step 87 is judged whether or not $N > N1$ and advance is made to step 88 if $N > N1$ and to step 92 if $N \leqq N1$. In step 88 is judged whether or not $N < N2$ and if $N < N2$ region flag Fb1 is set in step 89. If $N \geqq N2$, advance is made to step 95. In step 92 is judged whether or not $N > N3$, and advance is made to step 93 if $N > N3$ and to step 95 if $N \leqq N3$. In step 93 is judged whether or not $N < N4$ and advance is made to step 94 to set region flag Fb2 if $N < N4$ and to step 95 if $N \geqq N4$. In step 95 are reset both region flags Fb1, Fb2.

In steps 99-111 are set region flag F1 and detection permitting flag Fst of frequency f and reset region flag F2 if $X1 < Q/N < X2$ and $N1 < N < N2$, and if $X3 < Q/N < X4$ and $N3 < N < N4$, region flag F2 and detection permitting flag Fst are set, region flag F1 is reset and F1, F2 and Fst are reset in the other cases. In step 99 is judged whether or not both Fa1 and Fb1 are 1 and if they are 1 advance is made to step 100 and to step 104 if they are not 1. In step 100 is set F1 and in step 101 is reset F2. In step 104 is judged whether or not both Fa2 and Fb2 are 1 and advance is made to step 105 if they are judged to be 1 and to step 110 if they are not. In step 105 is set F2 and in step 106 is reset F1. In step 107 is set Fst. In step 110 are reset both F1 and F2 and in step 111 is reset Fst.

Figure 8A:
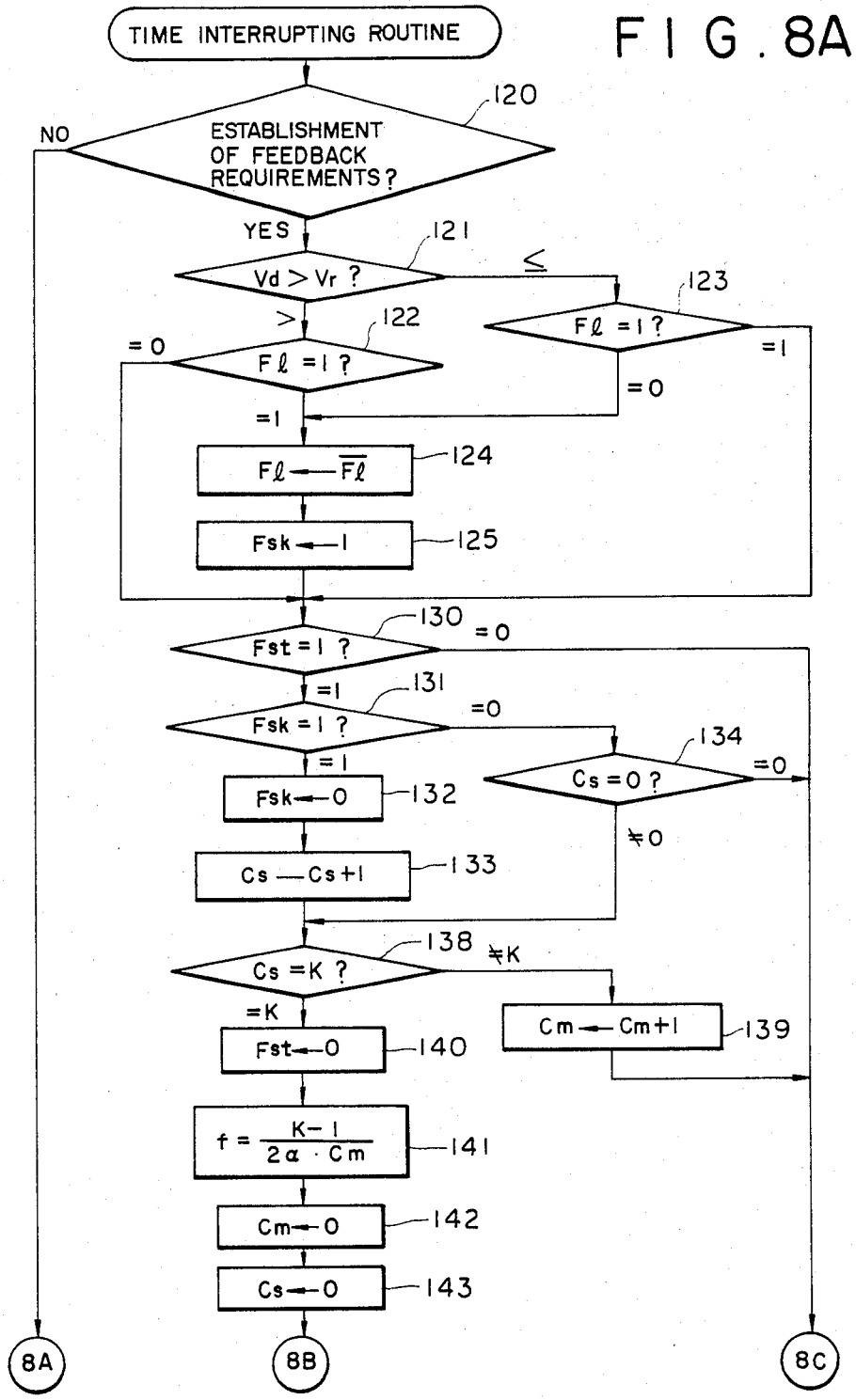
FIG. 8*a* and 8*b* are flow charts showing time interrupting routines for correcting comparative voltage.
Figure 8B:
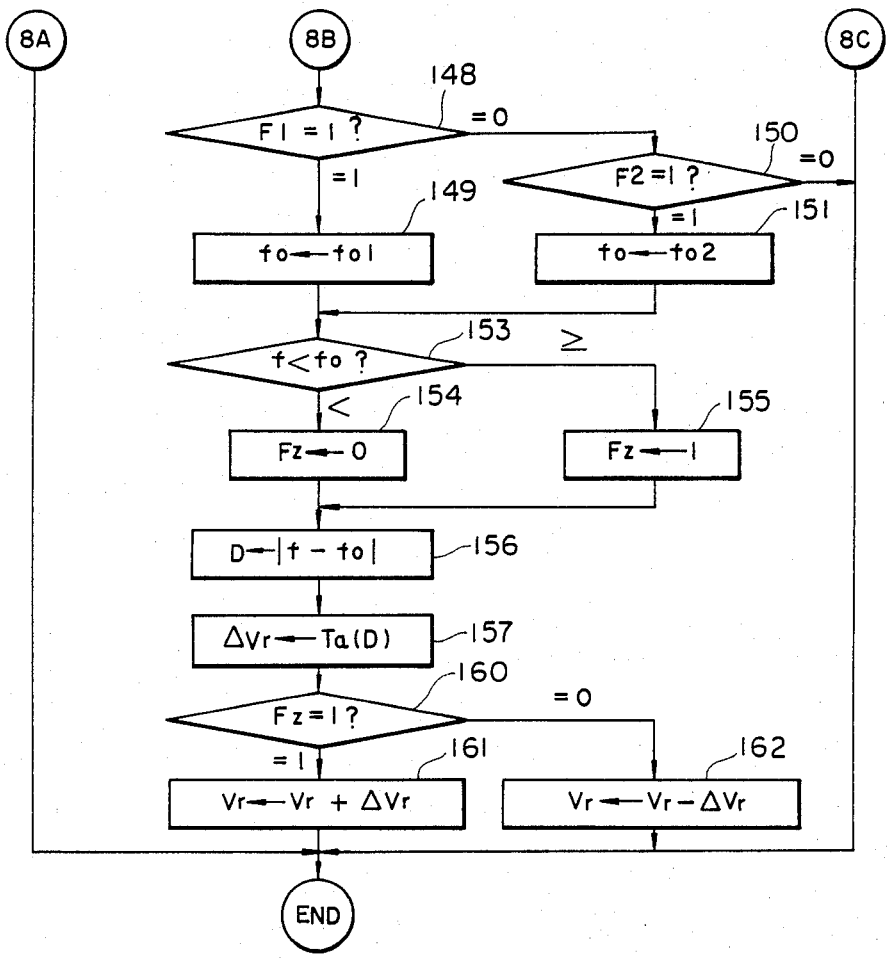

FIG. 8 is a flow chart of a time interrupting routine, wherein the frequency f of the air-fuel ratio detecting signal Vd is detected and the comparative voltage Vr is corrected on the basis of the frequency f. In steps 121–125 is judged whether or not the air-fuel ratio detecting signal Vd crosses the comparative voltage Vr, and cycle flag Fsk is set if the former crosses the latter. In steps 131–143, time during which the number of times of changes in the air-fuel ratio detecting signal Vd amounts from 1 to K is counted by a time counter to calculate the frequency f from value Cm of the time counter. In steps 148–151 is read the basic frequency fo at every detecting region and in steps 153–162 is corrected the comparative voltage Vr by deviation D of the detected frequency f from the basic frequency fo.

In step 120 is judged whether or not feedback requirements are established in the same manner as in said step 66, and advance is made to the succeeding programs only if they are judged to be established. In step 121 is judged whether or not the air-fuel ratio detecting signal $Vd > Vr$ and advance is made to step 122 if $Vd > Vr$ and to step 123 if $Vd \leqq Vr$. In step 122 is judged whether or not lean flag Fl is equal to 1, and advance is made to step 124 if $Fl = 1$ and to step 130 if $Fl = 0$. In step 123 is judged whether or not lean flag Fl is equal to 1, and advance is made to step 130 if Fl=1 and to step 124 if Fl=0. When the air-fuel ratio detecting signal Vd is thus changed from rich signal to lean signal or vice versa, steps 124, 125 are implemented. In step 124 is inverted Fl and in step 125 is set cycle flag Fsk.

In step 130 is judged whether or not detection permitting flag Fst=1 and advance is made to the succeeding steps only if Fst=1. In step 131 is judged whether or not cycle flag Fsk=1 and advance is made to step 132 if Fsk=1 and to step 134 if Fsk=0. In step 132 is reset flag Fsk and in step 133 is increased cycle frequency counter value Cs by 1. In step 134 is judged whether or not the cycle frequency counter value Cs=0 and if Cs=0 the succeeding steps is omitted and if Cs≠0, advance is made to step 138. In step 138 is judged whether or not the cycle frequency counter value Cs=K (K is a constant) and if Cs=K, advance is made to step 140 if Cs=K and to step 139 if Cs≠K. In step 139 is increased time counter value Cm by 1. In step 140 is reset detection permitting flag Fst. In step 141, $(K-1)/2\alpha \cdot Cm$ is substituted for f, provided $\alpha$ is interrupting cycle in the program of FIG. 8.

In step 142 is substituted 0 for the time counter value Cm and in step 143 is substituted 0 for the cycle frequency counter value Cs.

In step 148 is judged whether or not region flag F1=1 and advance is made to step 149 if F1=1 and to step 150 if F1=0.

Figure 9:
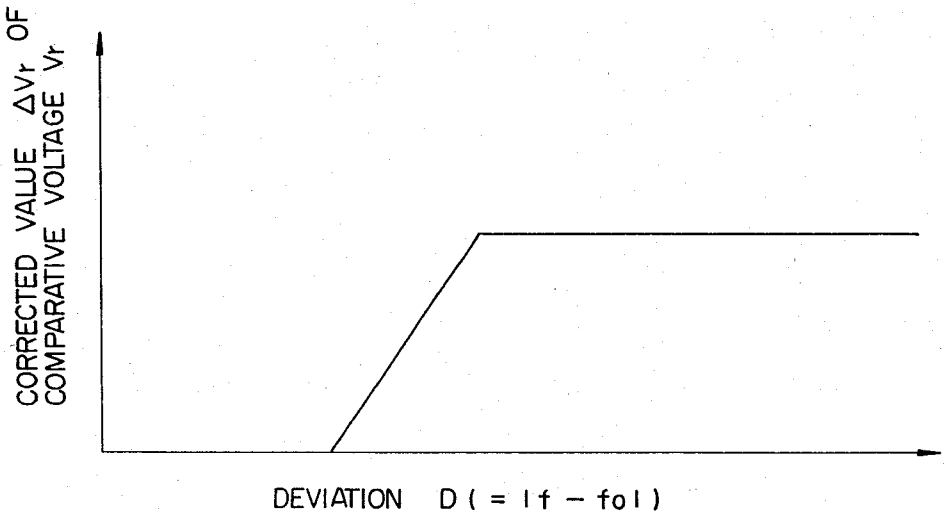
FIG. 9 is a graph showing the relationship between the detecting frequency of the air-fuel ratio detecting signal and corrected value of comparative voltage.

In step 149 is read the basic frequency fo1 in the region corresponding to the region flag F1 from ROM 57 to be substituted for fo. In step 150 is judged whether or not the region flag F2=1, and advance is made to step 151 if F2=1 and the implementation of the succeeding steps is omitted if F2≠1. In step 151 is read the basic frequency fo2 in region corresponding to the region flag F2 from ROM 57 to be substituted for fo. In step 153 is judged whether or not f<fo and advance is made to step 154 to reset rich sensor flag Fz if f<fo, i.e. $O_2$ sensor 31 becomes lean sensor and to step 155 to set rich sensor flag Fz if f≧fo, i.e. $O_2$ sensor 31 becomes rich sensor. In step 156, deviation lf-fo1 is substituted for D. In step 157 is calculated correction value ΔVr from deviation D on the basis of table Ta. FIG. 9 shows the relationship between D in table Ta and correction value ΔVr. The maximum value of ΔVr is limitted. In step 160 is judged whether rich sensor flag Fz=1 and advance is made to step 161 to substitute Vr+ΔVr for comparative voltage Vr if Fz=1, i.e. $O_2$ sensor 31 is rich sensor and to step 162 to substitute Vr−ΔVr for comparative voltage Vr if Fz=0, i.e. $O_2$ sensor 31 is lean sensor. When thus the $O_2$ sensor 31 is lean sensor, the comparative voltage Vr is reduced, resulting in the increase of integrated amount Vi and the decrease of fuel injection amount. On the contrary when the $O_2$ sensor 31 is rich sensor, the comparative voltage Vr is increased, resulting in the decrease of integrated amount Vi and fuel injection amount.

Figure 10:
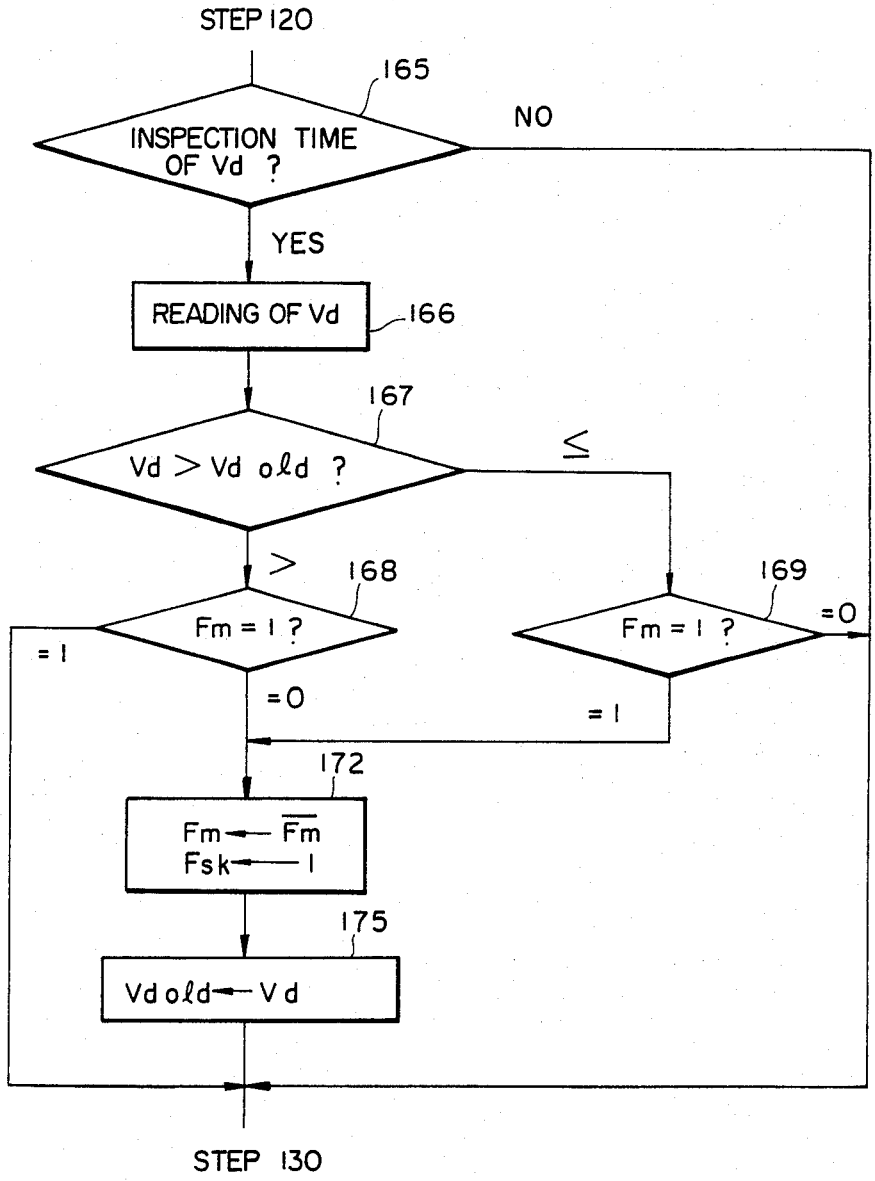
FIG. 10 is a flow chart of a portion of routine for detecting the frequency of the air-fuel ratio detecting signal from change in increase and decrease.

In step 157 is calculated the correction value ΔVr of the comparative voltage Vr. However, instead of ΔVr, may be calculated correction values ΔSka, ΔSkb of skip amounts Ska, Skb, correction values ΔTda, ΔTdb of delay time Tda, Tdb or correction values ΔKia, ΔKib of slopes Kia, Kib to correct these correction values ΔSka and others in steps 161, 162. In this case Ska, Tdb and |Kia| are corrected to increase in the rich sensor and Skb, Tda and |Kib| are corrected to increase in the lean sensor. Flow chart in FIG. 10 is implemented in lieu of steps 121–125 in FIG. 8. In this flow chart is detected that the air-fuel ratio detecting signal Vd is changed from increase to decrease or vice versa, instead of that Vd crosses the comparative voltage Vr, and when such change takes place, cycle flag Fsk is set.

In step 165 is judged whether or not it is the inspection time of the air-fuel ratio detecting signal Vd and steps 166–173 are implemented only when it is said inspection time. Generally the inspection of Vd is implemented in a cycle larger than the generating cycle of time interrupting signal. In step 166 is read the air-fuel ratio detecting signal Vd. In step 167 is compared this time Vd with the previous Vd (=Vdold) and advance is made to step 168 if Vd>Vdold and to step 169 if Vd≦Vdold. In step 168 is judged whether or not increase flag Fm=1 and steps 172, 173 are implemented only when Fm=0. In step 169 is judged whether increase flag Fm=1 and steps 172, 173 are implemented only when Fm=1. In step 172 is inverted increase flag Fm and set cycle flag Fsk. In step 173 is substituted Vd for Vdold.

Figure 11:
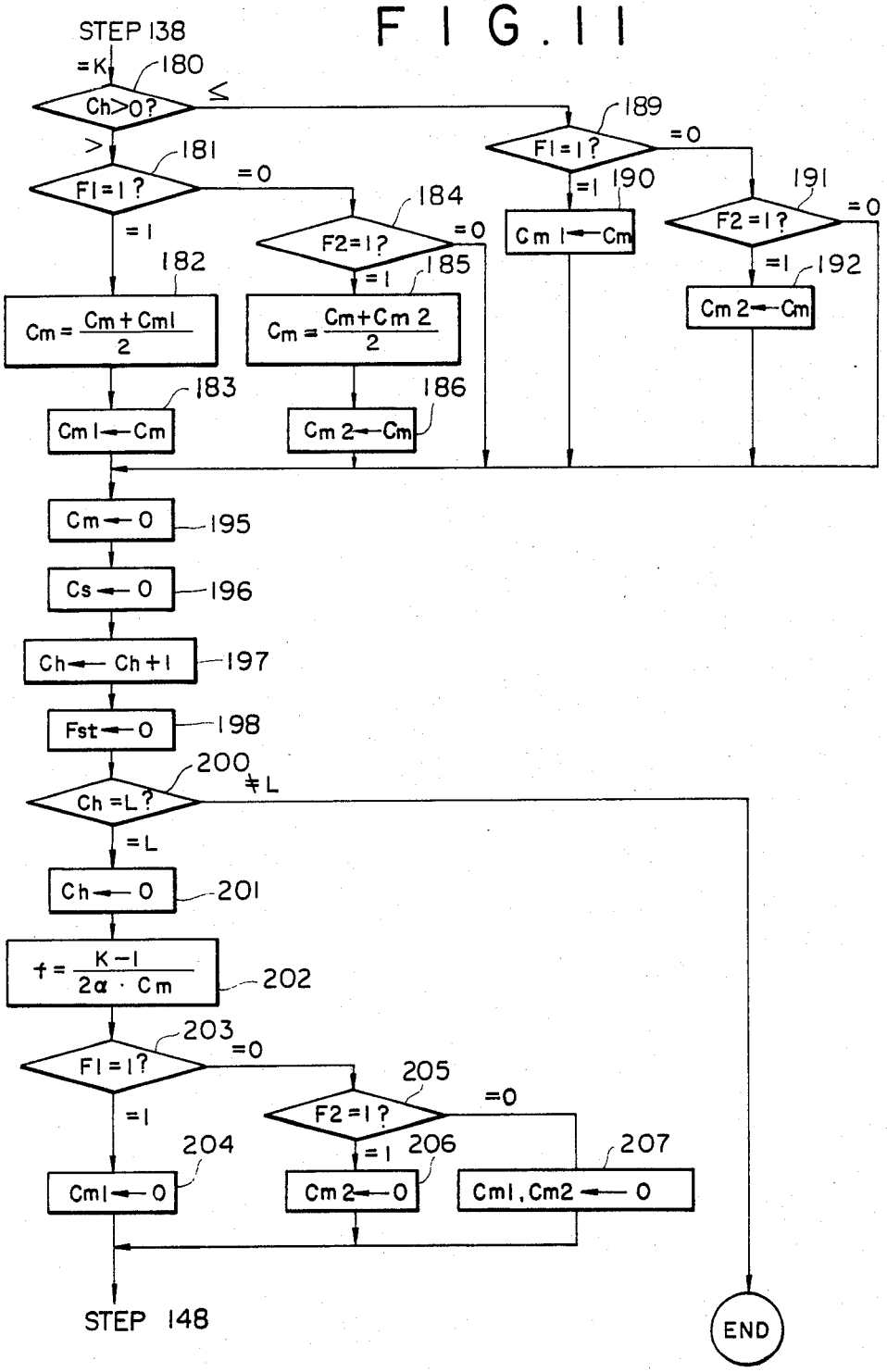
FIG. 11 is a flow chart of a program for obtaining average value of detected frequency of the air-fuel ratio detecting signal.

FIG. 11 is a flow chart of a program implemented instead of steps 140–143 shown in FIG. 8. Through frequency f was calculated on the basis of new Cm every time cycle frequency counter value Cs amounts to K in steps 140–143, in FIG. 11, frequency f is calculated in every detecting region (regions corresponding to region flags F1, F2), while Cm is made average value of new Cm measured this time and proceding values to calculate f on the basis of the averaged Cm. Thus f is prevented from having extraordinary value to improve reliability of f value. In steps 180 and 189–192, the initial counting result Cm of a time counting counter is substituted for Cm1 or Cm2 at every detecting region. In steps 180–186 is averaged Cm at every detecting region. In steps 200–207 is calculated f on the basis of Cm when the averaging frequency in each detecting region reaches L.

In step 180 is judged whether or not averaging frequency digital counter value Ch>0, and advance is made to step 181 if Ch>0 and to step 189 if Ch≦0. If Cm is the first time value, Ch=0. In step 181 is judged whether or not it is in the first detecting region, i.e. region flag F1=1, and advance is made to step 182 if F1=1 and to step 184 if F1=0. In step 182 is substituted average value (Cm+Cm1)/2 of time digital counter value Cm and average value Cm1 of the preceding Cms in the first detecting region for Cm. In step 183 is substituted Cm for Cm1. In steps 184–186 is processed the second detecting region in the same way as the first detecting region. In step 189 is judged whether or not region Flag F1=1, and advance is made to step 190 to substitute Cm for Cm1 if F1=1 and to step 191 if F1=0. In step 191 is judged whether or not region flag F2=1 and advance is made to step 192 to substitute Cm for Cm2 if F2=1 and to step 195 if F2=0. In step 195 is substituted 0 for time digital counter value Cm. In step 196 is substituted 0 for cycle frequency counter value Cs. In step 197 is increased averaged frequency digital counter value Ch by 1. In step 198 is reset detection permitting flag Fst. In step 200 is judged whether or not the averaged frequency digital counter value Ch=L and advance is made to step 201 if Ch=L and the succeeding steps are omitted if Ch≠L. In step 201 is substituted 0 for Ch. In step 202 is calculated f from $(K-1)/2\alpha \cdot Cm)$ in the same way as step 141 in FIG. 8. In step 203 is judged whether or not region flag F1=1 and advance is made to step 204 to substitute 0 for Cm1 if F1=1 and to step 205 if F1=0. In step 205 is whether or not region flag F2=1, and advance is made to step 206 if F2=1 to substitute 0 for Cm2 and to step 207 to substitute 0 for Cm1 and Cm2 if F2=0.

What is claimed is:

1. An air-fuel ratio control apparatus comprising:

means for generating an air-fuel ratio detecting signal related to the ratio of an air-fuel mixture supplied to a combustion chamber;

processing means for: (1) generating an integrated amount which is increased or decreased in relation to said air-fuel ratio detecting signal on the basis of a parameter value to correct a fuel amount supplied to an intake system, (2) detecting the frequency of said air-fuel ratio detecting signal, and (3) correcting said parameter value on the basis of the frequency of said air-fuel ratio detecting signal such that the frequency of said air-fuel ratio detecting signal becomes a basic frequency which is a frequency of said air-fuel ratio detecting signal when the air-fuel ratio in said combustion chamber reaches a predetermined value; and means for controlling the amount of fuel supplied to said intake system on the basis of said integrated amount.

2. An air-fuel ratio control apparatus as defined in claim 1, wherein said processing means corrects said parameter value on the basis of deviation of the frequency of said air-fuel ratio detecting signal from the basic frequency.

3. An air-fuel ratio control apparatus as defined in claim 2, wherein said basic frequency is defined as the frequency of said air-fuel ratio detecting signal when the air-fuel ratio in the combustion chamber becomes approximately a stoichiometric air-fuel ratio.

4. An air-fuel ratio control apparatus as defined in claim 1, wherein said processing means generates said integrated value by comparing said air-fuel ratio detecting signal with said parameter value to generate a binary variable, said integrated amount being increased or decreased in relation to said binary variable.

5. An air-fuel ratio control apparatus as defined in claim 1 wherein said processing means causes said integrated amount to be increased or decreased by a skip amount, which is selected as said parameter value, when said air-fuel ratio detecting signal crosses a comparative value.

6. An air-fuel ratio control apparatus as defined in claim 1, wherein said processing means causes said integrated amount to be increased or decreased by a skip amount a delay time after said air-fuel ratio detecting signal crosses a comparative value, said delay time being selected as said parameter value.

7. An air-fuel ratio control apparatus as defined in claim 1, wherein said processing means causes said integrated amount to be increased or decreased in relation to time with a predetermined slope, which is selected as said parameter value.

8. An air-fuel ratio control apparatus as defined in claim 1, wherein said processing means detects said frequency by counting the number of times said air-fuel ratio detecting signal crosses a comparative value.

9. An air-fuel ratio control apparatus as defined in claim 1, wherein said processing means detects said frequency by counting the number of times said air-fuel ratio detecting signal is changed between increasing and decreasing.

10. An air-fuel ratio control apparatus as defined in claim 1, wherein the detecting region of the frequency of the air-fuel ratio detecting signal is limited.

11. An air-fuel ratio control apparatus as defined in claim 10, wherein said detecting region is defined on the basis of vehicle speed, speed of revolution of engine, engine load, opening of throttle value or shift position of automatic transmission.

12. An air-fuel ratio control apparatus as defined in claim 10, wherein the corrected parameter value applies over the whole running region of an engine.

13. An air-fuel ratio control apparatus as defined in claim 1, wherein said processing means corrects said parameter value on the basis of averaged value of detected frequency of said air-fuel ratio detecting signal.

14. A method of controlling air-fuel ratio in an engine having an intake system connected to a combustion chamber, said method comprising the steps of:

generating an air-fuel ratio detecting signal related to the ratio of an air-fuel mixture supplied to said combustion chamber;

generating an integrated amount which is increased or decreased in relation to said air-fuel ratio detecting signal on the basis of parameter values to correct a fuel amount supplied to said intake system;

detecting the frequency of said air-fuel ratio detecting signal;

correcting said parameter value on the basis of the frequency of said air-fuel ratio detecting signal such that the frequency of said air-fuel ratio detecting signal approaches a basic frequency which is a frequency of said air-fuel ratio detecting signal when the air-fuel ratio in said combustion chamber reaches a predetermined value; and controlling the amount of fuel supplied to said intake system on the basis of said integrated amount.

15. A method as in claim 14 wherein said correcting step corrects said parameter value on the basis of deviation of the frequency of said air-fuel ratio detecting signal from said basic frequency.

16. A method as in claim 15 wherein said basic frequency is defined as the frequency of said air-fuel ratio detecting signal when the air-fuel ratio in said combustion chamber becomes approximately a stoichiometric air-fuel ratio.

17. A method as in claim 14 wherein said generating step generates said integrated value by comparing said air-fuel ratio detecting signal with said parameter value to generate a binary variable, and increasing or decreasing said integrated amount in relation to said binary variable.

18. A method as in claim 14 wherein said generating step increase or decreases said integrated amount by a skip amount, which is selected as said parameter value, when said air-fuel ratio detecting signal crosses a comparative value.

19. A method as in claim 14 wherein said generating step increases or decreases said integrated amount by a skip amount a predetermined delay time after said air-fuel ratio detecting signal crosses a comparative value, said delay time being selected as said parameter value.

20. A method as in claim 14 wherein said integrated amount generating step increases or decreases said integrated amount in relation to time with a predetermined slope, which is selected as said parameter value.

21. A method as in claim 14 wherein said detecting step includes the step of counting the number of times said air-fuel ratio detecting signal crosses a comparative value.

22. A method as in claim 14 wherein said detecting step includes the step of counting the number of times said air-fuel detecting signal is changed between increasing and decreasing.

23. A method as in claim 14 wherein the detecting region of the frequency of said air-fuel ratio detecting signal is limited.

24. A method as in claim 23 wherein said detecting region is defined on the basis of vehicle speed, speed of revolution of said engine, engine load, opening of throttle valve or shift position of an automatic transmission.

25. A method as in claim 23 wherein the corrected parameter value applies over the whole running region of said engine.

26. A method as in claim 14 wherein said correcting step corrects said parameter value on the basis of averaged value of detected frequency of said air-fuel ratio detecting signal.

* * * * *